United States Patent [19]

Anderson et al.

[11] Patent Number: 4,684,195

[45] Date of Patent: Aug. 4, 1987

[54] SOLDERLESS ELECTRICAL CONNECTOR

[75] Inventors: Jerry M. Anderson, Austell; Thomas C. Cannon, Jr., Dunwoody; Bruce V. Darden, Lawrenceville; Donald T. Smith, Norcross, all of Ga.

[73] Assignee: American Telephone and Telegraph Company, AT&T Bell Laboratories, Murray Hill, N.J.

[21] Appl. No.: 810,980

[22] Filed: Dec. 19, 1985

[51] Int. Cl.[4] ..... H01R 4/24

[52] U.S. Cl. ..... 439/404; 439/409

[58] Field of Search ..... 339/97 R, 97 P, 98, 339/99 R

[56] References Cited

U.S. PATENT DOCUMENTS

| | | | |
|---|---|---|---|
| 3,511,921 | 5/1970 | Pasternak | 174/88 |
| 3,718,888 | 2/1973 | Pasternak | 339/98 |
| 3,936,128 | 2/1976 | D'Annessa et al. | 339/98 |
| 4,138,184 | 2/1979 | Knopp | 339/97 P |
| 4,472,596 | 9/1984 | Brown et al. | 339/97 R |
| 4,538,874 | 9/1985 | Dambach et al. | 339/97 P |

*Primary Examiner*—Joseph H. McGlynn

*Attorney, Agent, or Firm*—Eugen E. Pacher

[57] ABSTRACT

A solderless in-line connector has a U-shaped slotted contact member, with the slots extending the length of the respective upright portion of the member and into the base portion. This contact member geometry results, upon insertion of a wire into the slot, in elastic torsional as well as bending deformation of the contact member, which in turn permits accommodation of a wide range of wire sizes in a low profile connector. Further desirable features of the connector are the possibility of installation without use of special tools, and the possibility of sequential contact formation. The connector can advantageously be used for splicing small pair count cables, but it can also be adapted for making half taps.

6 Claims, 10 Drawing Figures

SOLDERLESS ELECTRICAL CONNECTOR

FIELD OF THE INVENTION

This invention relates to solderless electrical connectors, and particularly to such connectors adapted for electrically connecting one, two, or more pairs of insulated wires, e.g., telephone wires.

BACKGROUND OF THE INVENTION

Solderless electrical connectors are well known in the art. See, for instance, U.S. Pats. Nos. 3,718,888, 3,511,921, and 3,936,128. One type of solderless connector is made up of a base, one or more contact members, and a cover. Base and cover consist of an insulating material, frequently a molded polymeric material such as polycarbonate, and the contact members are made of electrically conducting elastic material, e.g., phosphor bronze. Contact members typically are U-shaped, with the two upward-pointing end portions of the contact member slotted to form pairs of opposing "posts" that extend part of the length of the respective end portions of the member. Configuration of the contact members is such that, when an insulated wire is forced into the slot, the insulation is pierced and the contact member makes electrical contact with the wire conductor. The top of the connector is mated with the base to protect and insulate the splice.

Various contact member geometries are known to the prior art. For instance, in the noted U.S. Pat. No. 3,511,921, the slots used in the contact are relatively short, have parallel inner walls terminating in a bottom wall perpendicular to the parallel inner walls, whereas U.S. Pat. No. 3,718,888 discloses a contact member with tapered slots.

It is generally important that the contact member be able to accommodate a range of conductor sizes, with the wires retaining a substantial fraction of the virgin wire strength, and to be able to achieve this while exerting at least the minimum required contact force on the smallest permitted wire, and without undergoing excessive defomation upon insertion of the largest permitted wire. The above-described contact member configurations may in certain instances experience a small but still undesirable localized plastic deformation.

A slot configuration that permits the use of relatively short slots while still preventing excessive plastic deformation of the posts is disclosed in U.S. Pat. No. 3,936,128. The slots are keyhole shaped i.e., a generally parallel sided slot terminates without sharp corners in a generally rounded feature having a diameter greater than the width of the slot. Such a contact does not significantly warp or distort during wire insertion since the stresses are distributed more evenly by virtue of the keyhole slot shape. Hence, elasticity of the contact is maintained and longevity of the connection is enhanced.

For obvious reasons, it is desirable for electrical connectors, e.g, connectors for telephone wires, to be as small as possible. In particular, it is desirable that such connectors have a low profile. However, prior art slotted beam contact elements cannot be adapted to the design of a connector having very low profile. This application discloses a connector which has very low profile, yet is able to accommodate a wide range of wire sizes, and to maintain efficient reliable contact with the wire conductors, due to the fact that the contact member undergoes only a limited amount of plastic deformation during wire insertion.

SUMMARY OF THE INVENTION

Connectors according to the invention comprise a base comprising contact member-receiving means, and at least one electrically conductive contact member positioned in the contact member-receiving means. The contact member is substantially U-shaped, having at least one pair of opposing posts adapted for receiving therebetween an insulated wire and for stripping the insulation from a portion of the wire. The pair of opposing posts extends the full length of the end portion of the contact member and furthermore extends into the central portion thereof. Insertion of a wire between the opposing posts produces both bending and torsion in the opposing posts, resulting in wider distribution of the stored elastic energy than in prior art contact members, which typically do not undergo torsional deformation. The novel contact geometry makes possible the design of connectors having very low profile.

It is also an object of the invention to provide a connector which can be installed without use of special tools. Further objects of the invention are the provision of a connector which is suited for forming in-line splices but which also can be adapted for forming half-taps, and the provision of a connector which permits sequential contact formation.

The invention, its further features, objects and advantages are fully described in the following detailed description of an exemplary embodiment.

BRIEF DESCRIPTION OF THE DRAWINGS

FIG. 5 shows the half-tap adapter member;

Like numerals are used to identify like features in different figures.

DETAILED DESCRIPTION OF A PREFERRED EMBODIMENT

Although the following description is in terms of a connector for electrically connecting each member of a pair of wires to the respective member of another pair of wires, it will be understood that the invention is not so limited. Indeed, the invention can be embodied in connectors for connecting a single wire to another wire, or for connecting any member of a multiplicity of wires (e.g., 3, 10, 25) to the respective member of another multiplicity of wires. Furthermore, the invention can be embodied in connectors that electrically connect one (or more) wires to a multiplicity of other wires. And finally, all these connections can be made between wires arranged in end-to-end fashion, as half-taps (tap wire joined to a through conductor) or as full taps (a through conductor joined to another through conductor).

Figure 1:
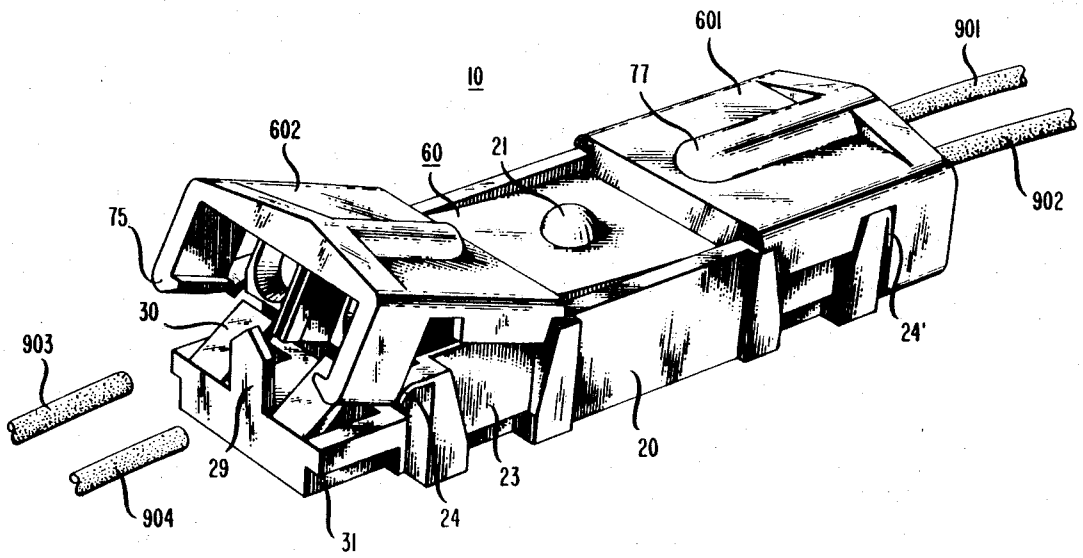
FIG. 1 shows a perspective drawing of a connector according to the invention.

A preferred embodiment 10 of the invention is depicted in FIG. 1, wherein 20 is the connector base, and 60 the connector cover. The base as well as the cover have left/right and fore/aft symmetry.

Prior to making the connections, both "wings" of the cover are in the "open" position, which permits easy insertion of the wire ends into wire receiving passages in the connector top. The connections are made independently and sequentially by urging both wings of the cover into the "closed" position.

The independent placement and sequential contact formation reduce the difficulty of installing connectors, as compared to prior art connectors which lack these attributes, since it makes it possible for the installer to secure one-half of the wires before dealing with the remainder. Other advantages features of the preferred embodiment allow making of the connections without the use of any special tool. These features comprise ribs 77 on the cover, which eliminate the need for a parallel-jawed tool, making possible the use of, e.g., long-nosed pliers for closing the connector.

FIG. 1 shows one cover wing (601) in the closed position, with insulated wires 901 and 902 held in the connector, and the other cover wing (602) in the substantially open position, with wires 903 and 904 schematically shown poised for insertion. Nub 21 is formed during assembly of the connector, which exemplarily comprises placing two contact members (see FIG. 2) into the base, optionally adding connector filling compound (see FIG. 7), placing the cover into position, with base post 26 (see FIG. 3) extending through cover hole 64 (see FIG. 4) and staking of the protruding part of 26 with an ultrasonic press, thereby forming nub 21 and attaching the cover to the base. The cover is held in the open position by cantilevers 24. These tabs are being bent downwardly during closing of the cover, as indicated by 24'. When in the closed position latch 75 engages step 31.

Figure 2:
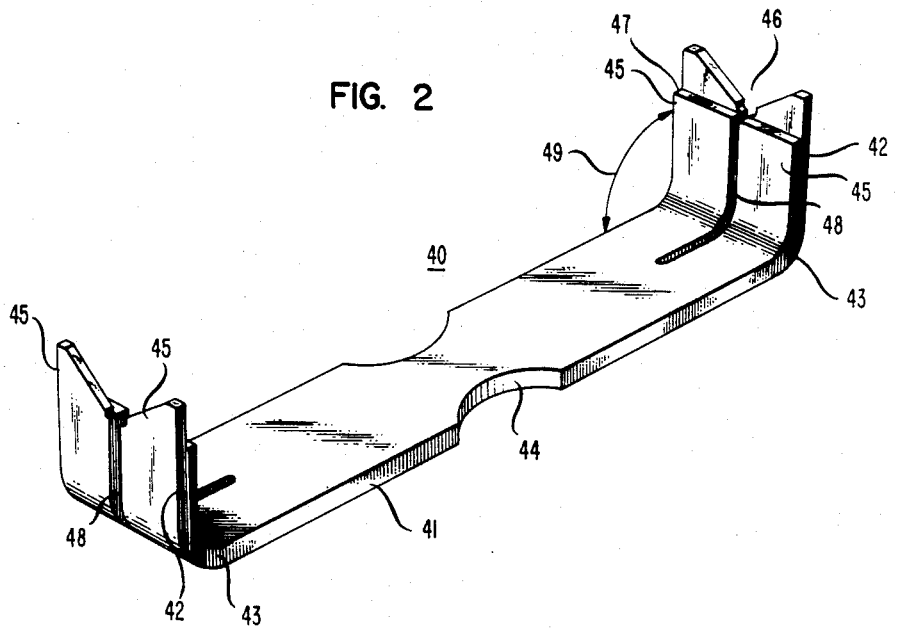
FIGS. 2, 3, and 4 show a contact member, the base, and the cover of the exemplary connector of FIG. 1.

A significant aspect of the instant invention is embodied in the contact member, whose geometry makes possible an advantageous low profile connector. FIG. 2 depicts an exemplary preferred contact member 40, which is basically a U-shaped strip of conductive material (e.g., solder plated phosphor bronze). The member can be considered to consist of three different portions, namely, central portion 41, end portions 42, and transition portions 43 between 41 and 42. Each end of the contact member is divided by a slot 48, thereby forming two pairs of opposing posts 45 which extend the length of the respective end portion 42 and transition portion 43 of the contact member, and furthermore extend into the base portion 41 of the contact member. An insulated wire is to be stuffed into slot 48, its entrance aided by V-shaped entrance 46, and the stripping of the insulation from the wire aided by optional stripping shoulder 47. Cut-outs 44 are provided as a means for locating the contact member in the connector base. Slots 48 can be of uniform or nonuniform width. In a currently preferred embodiment the slot is narrower near the wire entrance position than in the central portion of the connector.

Figure 8:
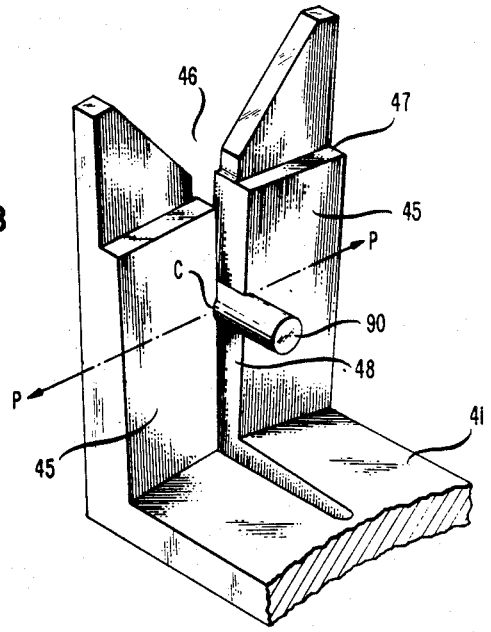
FIG. 8 illustrates the elastic deformations present in a contact member according to the invention.

Extension of slot 48 into base portion 41 not only makes possible a space-efficient low profile connector while preserving sufficient compliance of the contact member to be able to accommodate a substantial range of wire sizes (e.g., 22–26 AWG), but it also produces other advantageous results. In particular, insertion of a wire of appropriate gauge between the opposed posts of a contact member according to the invention causes elastic deformation of the contact member, with two deformation modes, bending and torsion, contributing to the total elastic deformation. The shape assumed by the contact member upon insertion of a wire is schematically shown in FIG. 8. In particular, FIG. 8 shows the torsional deformation of base 41.

The dual-mode deformation, inter alia, gives the contact member sufficient stiffness in the wire insertion direction to make possible complete penetration of the connector posts through the insulation, and insures long term electrical reliability. The latter effect is at least in part due to the fact that the elastic energy of deformation in torsion is substantially uniformly distributed over the length of the pair of opposed posts, and is not localized as is the case in cantilevered bending. The more distributed deformation in contact elements according to the invention reduces localized plastic deformation and thus leads to increased long term electrical reliability of the connector.

As indicated above, contact members according to the invention have relatively large compliance. For instance, it can be shown that an exemplary inventive contact member has a compliance $d_c/P$ of 0.335 mils/lb whereas an otherwise identical contact member in which the slot 48 does not extend beyond the end portion 42 has a compliance of 0.240 mils/lb. P is the lateral force acting at a point C, e.g., the clamping force on a wire inserted into slot 48, and $d_c$ is the lateral displacement at C of post 45 due to force P, as shown in FIG. 8.

Figure 9:
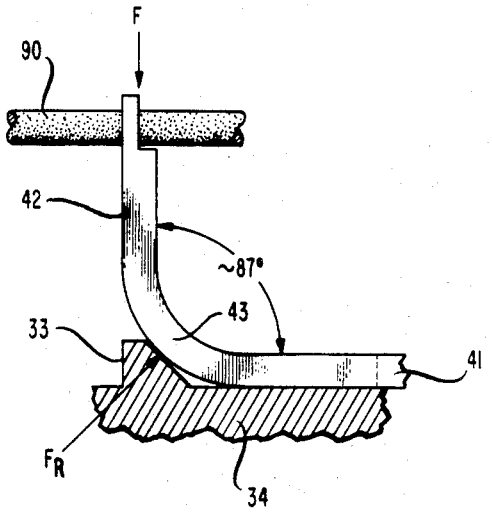
FIG. 9 schematically depicts a feature of the invention which results in the absence of a bending moment during wire insertion into the slotted contact member.

Angle 49 between base portion 41 and an end portion 42, referred to herein as the "included" angle, is of course less than 180°, since 42 is non-coplanar with 41, and typically is less than or equal to 90°. We have discovered that by making the included angle less than 90° (e.g., 87°), alone or in conjunction with providing means for supporting the contact member in the transition portion 43, it is possible to substantially reduce or eliminate the bending moment that may act on the posts during wire insertion into slot 48 of the contact member. Elimination of the bending moment results in increased reliability of the contact-making operation. In a preferred embodiment the relevant portions of base and contact member are configured substantially as schematically depicted in FIG. 9, wherein arrows F and $F_R$ signify the insertion force and the reaction force, respectively, and wherein the bending moment is essentially zero.

Figure 3:
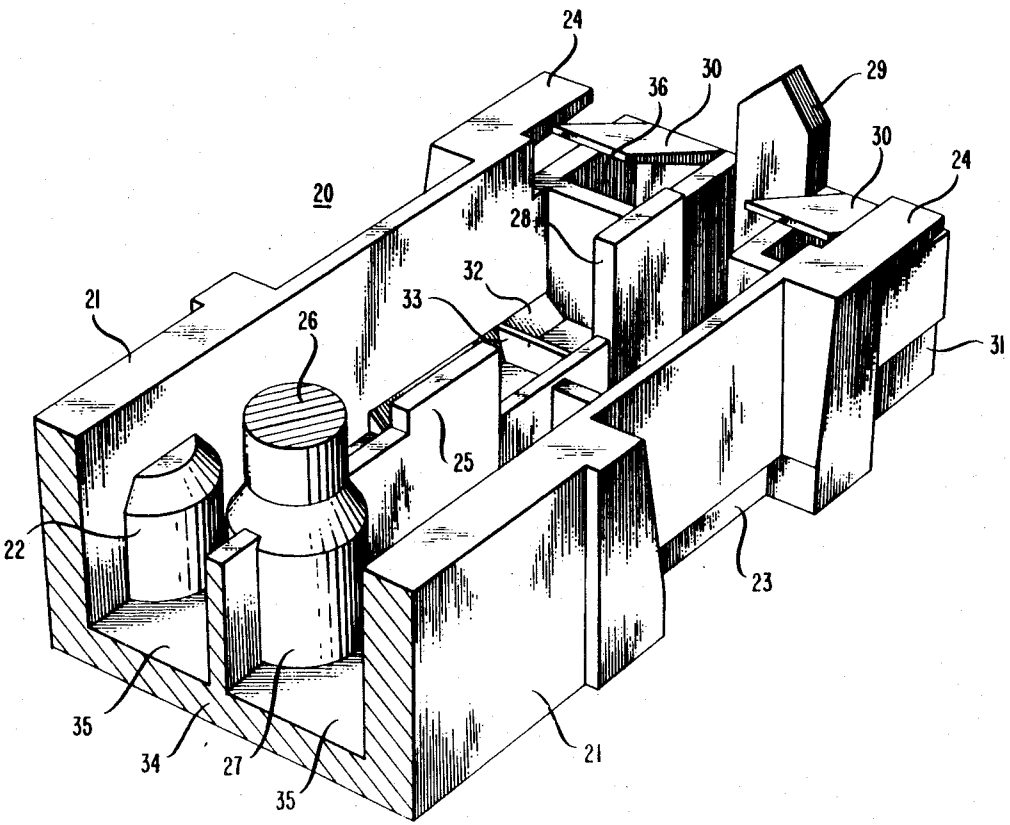

FIG. 3 shows, in partially cut-away view, the base 20 of the preferred connector. Although we currently prefer a molded plastic (e.g., injection molded polycarbonate) base and cover for the inventive connector, the invention is not so limited, and base and cover can be fabricated by any appropriate technique, using any appropriate dielectric material. Base 20 has basically a U-shaped cross section with sidewalls 21 and bottom 34, with central divider 25 forming two substantially identical contact member-receiving compartments 35. Nubs 22 and 27 fit into cut-outs 44 of the contact member, thereby locating the contact members with respect to the base. Similarly, corner wedge 32 locates the contact member, whereas cross ridge 33 supports transition region 43 of the contact member. Post 26 serves to attach cover 60 to the base, as discussed above. Cantilevers 24 hold the respective wing of the cover in the open position prior to closing of the connector, and are bent downwardly out of the way of the cover during closing of the connector wing. Raised portion 28 of dividing wall 25 mates with slot 72 of cover 60 with an interference fit (see FIG. 4), and serves to provide a cover wing position intermediate the fully open and the closed positions. It is advantageous to dimension cantilevers 24 such that moderate finger pressure suffices to close the wing from the fully open to the intermediate position. Tab 29 is provided to block wire entry into the base, and tongues 30 are strain relief features which increase the pull-out resistance of the connector. The tongues 30 are connected to the body of the base by means of a deformable joint which permits downward movement of the tongues while urging the tongues upward against the wire. Passages 36 are present for molding purposes only. Steps 31 and 23 in the sidewall of the base permit engagement of a cover latch and an index block latch, respectively. The index block, an alternative feature of the preferred embodiment that can be used instead of one cover wing, will be described below.

Figure 4:
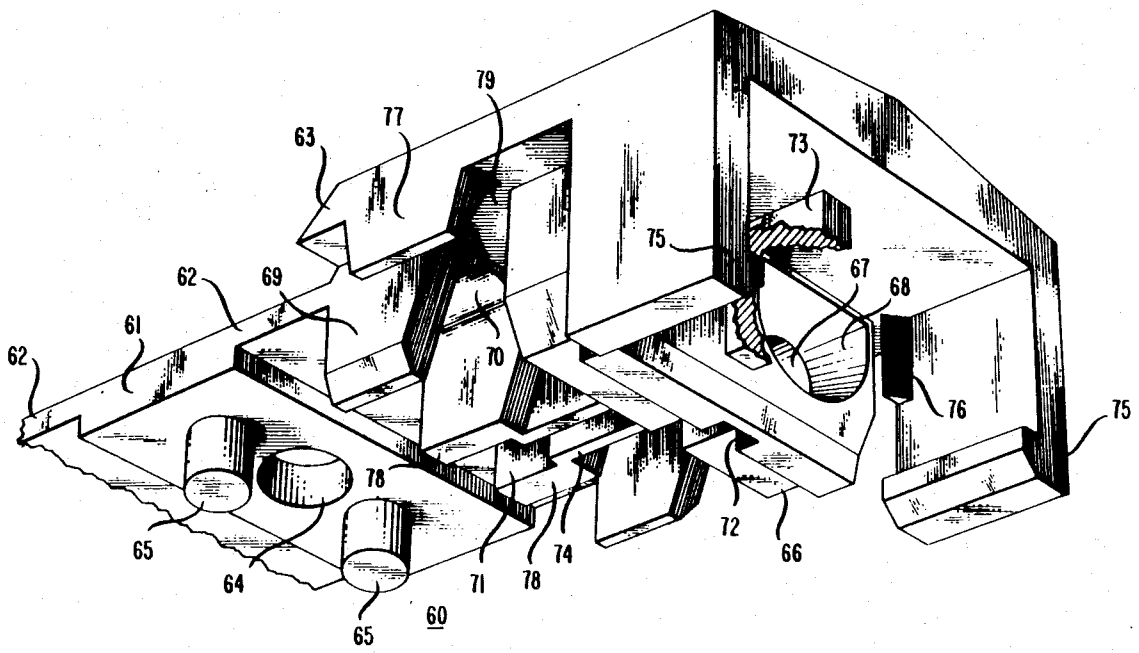

FIG. 4 shows a portion of cover 60, which comprises a center section 61, two end sections 63, and two hinge sections 62 flexibly joining 63 to 61. As discussed above, base post 26 is to be threaded through hole 64 and the cover secured to the base by staking, or by any other appropriate means. Pins 65 are provided to secure contact members 40 in the base. Each end section 63 comprises a transverse block 66, with two wire-receiving tunnels 67 therethrough. The entrance of each tunnel comprises a flared portion 68 which serves to guide the wire into 67. Wall 73 (shown partially removed for clarity) separates the two tunnel entrances, and corner deflectors 76 aid in smooth wire entry. In line with each tunnel 67 is a wire receiving passage 70 formed between outer and inner posts 69 and 78, respectively. Dividing walls 74 connect the respective inner posts to transverse block 66, completing the separation between the the two wire receiving channels. Slot 71 between inner posts 78 is adapted for receiving dividing wall 25 of the base, and slot 72 in transverse block 66 for mating with raised portion 28 of the dividing wall. Between transverse block 66 and posts 69 and 78 are provided contact receiving spaces 79, each adapted for accommodating an end portion of a contact member when the cover is fully closed. Latches 75 are designed to engage steps 31 of the base to hold the cover closed, and tab 77 is provided to block a potential shorting path to the contact member.

Figure 6:
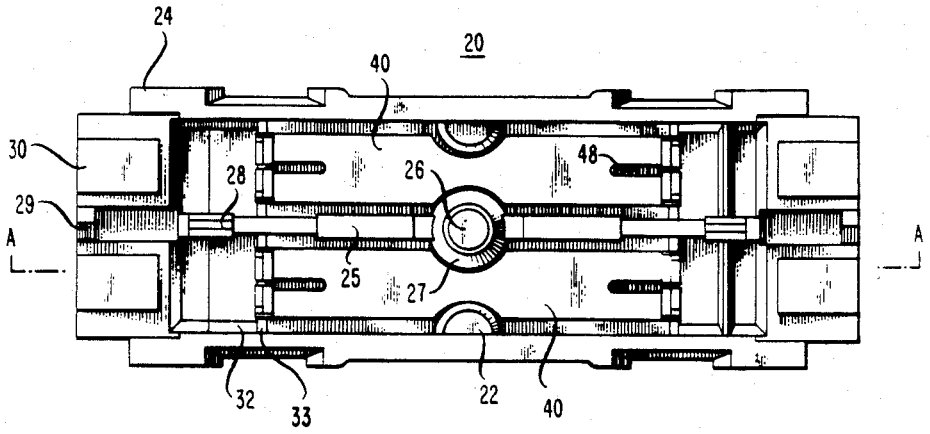
FIG. 6 shows the base in top view, with the contact members in place.
Figure 7:
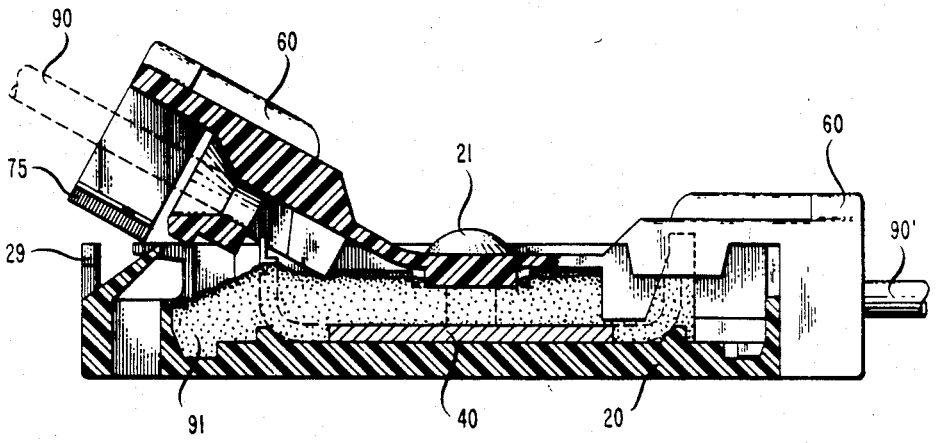
FIG. 7 shows a complete connector according to the invention in sectioned side view.

FIG. 6 shows base 20 in top view, with two contact members 40 in place. And FIG. 7 show base and contact member sectioned along line AA of FIG. 6, with cover 60 attached to the base and sectioned along a line corresponding to AA. One wing of the cover is shown in open position, with a wire 90 in place, whereas the other wing is shown in closed position, with a wire 90' inserted into slot 48, and with the insulation penetrated such that electrical contact is established between the wire and the contact member. The preferred connector may comprise a quantity 91 of a known connector filling compound (e.g., a polyethylene thermoplastic rubber), distributed substantially as indicated in FIG. 7, which may result in improved environmental performance of the connector.

The above-discussed preferred embodiment of the invention primarily serves to individually butt-couple two wire ends to two other wire ends. However, the preferred connector can also be adapted to form a half-tap, i.e., to individually connect the ends of two tapping wires to two through wires.

Figure 10:
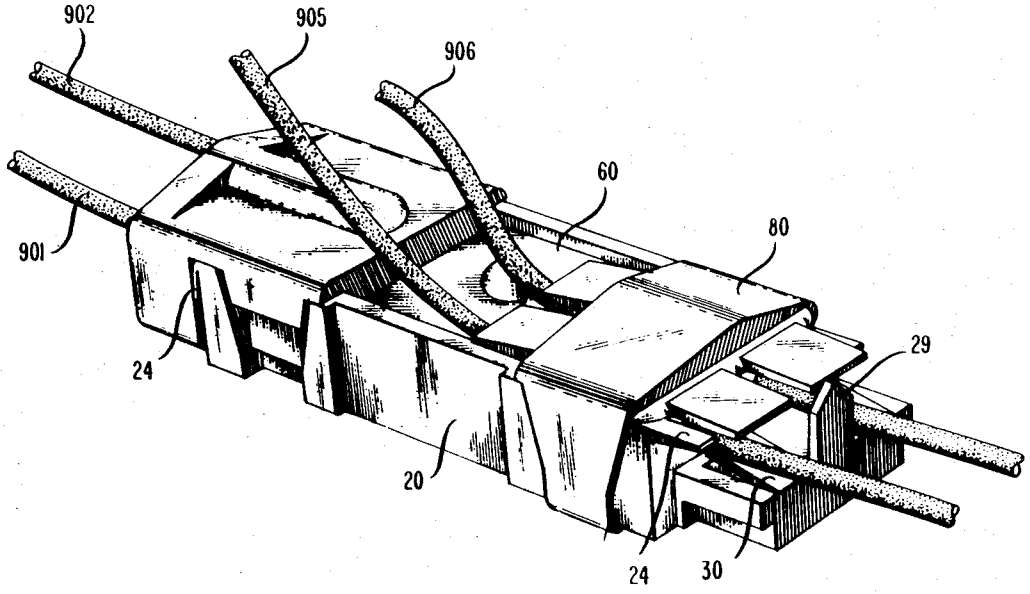
FIG. 10 depicts a connector according to the invention used as a half-tap.

In order to form a half tap, one of the two cover wings of the connector is removed, e.g., by manually twisting the wing off at joint 62. Into the remaining cover wing of the thus modified connector a pair of wire ends is inserted in the usual manner, and the cover wing closed, thereby establishing electrical connections between the wires and the respective contact members. An "index block" is then slipped over the two through wires to be tapped, and the index block urged over the modified half of the connector. The completed half-tap is depicted in FIG. 10, wherein 20 is the connector base, 60 the cover (modified by removal of one wing), 80 the index block (or half-tap adapter) 901 and 902 two wire ends, and 905 and 906 the through wires.

Details of the index block 80 are shown in FIG. 5. The molded dielectric (e.g., polycarbonate) index block has fore/aft symmetry and left/right symmetry, and comprises a cover plate 81 with latches 83 and strain relief clamps 82. Passage 85 separating blocks 84 is adapted for receiving therein dividing wall 25 of the base. Each block 84 is configured to provide a wire receiving passage 86, into which a through wire can be place by pushing it between deformable retainers 87. Each block is also configured to comprise contact receiving space 88.

After placing the two through wires into the respective wire receiving channels 86, the index block is placed over the base such that latches 83 fit into the respective groove leading to step 23, and the connection completed by urging (e.g., with long nose pliers) the index block over the base until latches 83 engage. In this position wires 905 and 906 are contactingly inserted between the respective posts of the contact members, completing the half-tap. It will be appreciated that contact to the through wires can of course be made before making contact to the tap wires.

What is claimed is:

1. A connector for electrically joining one or more wires to one or more other wires, the connector comprising a base, at least one electrically conductive contact member, and a cover comprising a central section, two end sections, and two hinge sections flexibly joining the central section to the respective end sections, wherein (a) the base comprises contact member receiving means and means for attaching the cover to the base;

(b) the contact member is positioned in the contact member receiving means, the contact member is a substantially U-shaped member consisting of a central portion, two end portions, and a transition portion between the central portion and each respective end portion, the contact member comprising two pairs of opposing posts, with a slot between the opposing posts, each pair of posts adapted for receiving therebetween a wire such that electrical contact between the contact member and the wire is established, each pair of opposing posts extending the length of the respective end portion and transition portion and also extending into the central portion;

(c) the cover is attached to the base, each cover end section comprising (i) wire receiving means forming a wire receiving passage comprising a void adapted for receiving therein the respective end portion of the contact member, (ii) means for engaging the base after the base and the end section of the cover are pressingly closed from an open position to a closed position, thereby intersecting the wire-receiving passage with the respective end portion of the contact member; and (iii) means, operative on closing, for placing a wire present in the wire-receiving passage into the slot between the respective opposing posts of the contact member.

2. Connector of claim 1, adapted for electrically joining the end of a first to the end of a second wire, and the end of a third to the end of a fourth wire.

3. Connector of claim 1, further comprising (a) means for holding the cover in the open position; and (b) means for holding the cover in a position intermediate the open position and the closed position.

4. Connector of claim 1, wherein the angle between the central portion and at least one end portion of the contact member is less than 90°, and wherein the base comprises means for supporting the contact member in the transition portion between the central portion and the at least one end portion.

5. Connector of claim 1, wherein the contact member comprises means for guiding a wire into the slot between the pair of opposed posts, with each post comprising a wire stripping shoulder.

6. Connector of claim 1, adapted for forming a half tap that electrically connects the end of at least one tap wire to an intermediate portion of an through wire, wherein the cover is adapted for having at least one end section removed therefrom and wherein the connector further comprises an index block comprising (a) wire receiving means forming at least one wire receiving passage comprising a void adapted for receiving therein the respective end portion of the contact member;

(b) means for engaging the base, operative after the index block is urged onto a cover-end section-free portion to intersect the index block wire receiving passage with the respective end portion of the contact member; and (c) means, operative during urging of the index block onto the base, for placing a wire present in the index block wire receiving passage into the space between the respective opposing posts of the contact member.

* * * * *